US007500570B2

(12) United States Patent
Kurcheski

(10) Patent No.: US 7,500,570 B2
(45) Date of Patent: Mar. 10, 2009

(54) MOUNTABLE BALL HOLDER

(75) Inventor: John Russell Simonetta Kurcheski, York, PA (US)

(73) Assignee: Kurt Kay, York, PA (US)

( * ) Notice: Subject to any disclaimer, the term of this patent is extended or adjusted under 35 U.S.C. 154(b) by 421 days.

(21) Appl. No.: 11/010,070

(22) Filed: Dec. 10, 2004

(65) Prior Publication Data

US 2006/0124562 A1 Jun. 15, 2006

(51) Int. Cl.
*A47F 7/00* (2006.01)

(52) U.S. Cl. ..... 211/14

(58) Field of Classification Search ..... 211/14, 211/85.7, 32, 87.01; D6/552; 206/315.9; 220/508; 411/372.5–373, 374–377
See application file for complete search history.

(56) References Cited

U.S. PATENT DOCUMENTS

| | | | | | |
|---|---|---|---|---|---|
| 1,024,536 | A | * | 4/1912 | Taylor | 206/315.9 |
| 1,294,916 | A | * | 2/1919 | Knight | 211/103 |
| 1,386,078 | A | * | 8/1921 | Schulze | 211/14 |
| 1,500,544 | A | * | 7/1924 | Brockley | 99/440 |
| 1,814,887 | A | | 7/1931 | Bender | |
| 2,288,710 | A | * | 7/1942 | Hotchkin | 411/520 |
| 2,334,046 | A | * | 11/1943 | Tinnerman | 411/374 |
| 2,617,280 | A | * | 11/1952 | Anderson | 211/14 |
| 2,694,997 | A | * | 11/1954 | Alger, Jr. | 116/106 |
| 2,926,912 | A | * | 3/1960 | Gould | 473/554 |
| 3,412,897 | A | * | 11/1968 | Slater | 221/226 |
| 3,611,863 | A | * | 10/1971 | Bayer et al. | 411/371.1 |
| D240,059 | S | | 5/1976 | Lewis, Jr. | D21/2 |
| D242,402 | S | | 11/1976 | Bratene et al. | D2/400 |
| 4,129,060 | A | * | 12/1978 | Gould | 411/372.5 |
| 4,294,386 | A | | 10/1981 | Ingram | |
| 5,209,539 | A | * | 5/1993 | Atalay | 294/143 |
| 5,232,101 | A | * | 8/1993 | Shaftner et al. | 211/14 |
| D363,520 | S | | 10/1995 | Melillo | D21/234 |
| D375,626 | S | | 11/1996 | Eaton et al. | D3/257 |
| 5,651,651 | A | * | 7/1997 | Spencer | 411/372.6 |
| 6,250,481 | B1 | * | 6/2001 | Chang et al. | 211/87.01 |
| 6,454,105 | B1 | | 9/2002 | Medina | 211/14 |
| 6,601,711 | B1 | | 8/2003 | Knable, III | 211/14 |

(Continued)

FOREIGN PATENT DOCUMENTS

BE 888 342 A1 7/1981

OTHER PUBLICATIONS

Ball & Helmet Holders, LLC, Website for Ball and Helmet Holders, <www.ballandhelemtholder.com/isapi/isapi/dll> dated Aug. 9, 2005, pp. 1-3.

(Continued)

*Primary Examiner*—Jennifer E. Novosad
(74) *Attorney, Agent, or Firm*—Barley Snyder LLC

(57) ABSTRACT

A mountable ball holder comprises a receiving member and a cover. The receiving member has resilient first, second, and third arcuate members that define a ball receiving area. The first, second, and third arcuate members each lie in a separate plane and converge to form a mounting portion. The mounting portion has at least one attachment member for securing an external surface of the mounting portion to a support structure. The cover is secured to an internal surface of the mounting portion such that the cover conceals the at least one attachment member.

16 Claims, 6 Drawing Sheets

U.S. PATENT DOCUMENTS

| | | | | |
|---|---|---|---|---|
| D479,650 | S | 9/2003 | Kan | D3/257 |
| D532,197 | S * | 11/2006 | Niksich | D3/221 |
| 7,207,446 | B1 * | 4/2007 | Boston | 211/14 |
| 2004/0182802 | A1 * | 9/2004 | Paul | 211/75 |

OTHER PUBLICATIONS

PCT International Search Report dated Mar. 27, 2006 for Application No. PCT/US2005/042599.

* cited by examiner

MOUNTABLE BALL HOLDER

FIELD OF THE INVENTION

The invention generally relates to a ball holder and, more particularly, the invention relates to a mountable ball holder that mounts to a support structure and has a plurality of resilient arcuate members that receive and retain or hold a ball there between.

BACKGROUND OF THE INVENTION

Whether at school, at the gym, or at home, the storage and/or display of a ball such as, a basketball, football, exercise ball, or the like, can be a frustrating experience. Keeping the ball securely on a shelf, on the floor, or in any other storage location is virtually impossible, because the ball invariably rolls from its desired position. Not only is a loose ball potentially dangerous, but a loose ball is more susceptible to damage. Additionally, loose balls will cause an area to have a cluttered appearance. Accordingly, there exists a need for a mountable ball holder that can securely hold a ball in a desired location. There further exists a need for a mountable ball holder that is easy to use and assemble.

SUMMARY OF THE INVENTION

It is accordingly an object of the invention to provide a mountable ball holder comprising a receiving member having resilient first, second, and third arcuate members that define a ball receiving area. The first, second, and third arcuate members each lie in a separate plane and converge to form a mounting portion. The mounting portion has at least one attachment member for securing the receiving member to a support structure.

It is further an object of the invention to provide a mountable ball holder comprising a receiving member and a cover. The receiving member has first, second, and third arcuate members that extend from a mounting portion. The first, second, and third arcuate members define a ball receiving area. The mounting portion has at least one attachment member for securing an external surface of the mounting portion to a support structure. The cover is secured to an internal surface of the mounting portion such that the cover conceals the at least one attachment member.

DETAILED DESCRIPTION OF THE INVENTION

Figure 1:
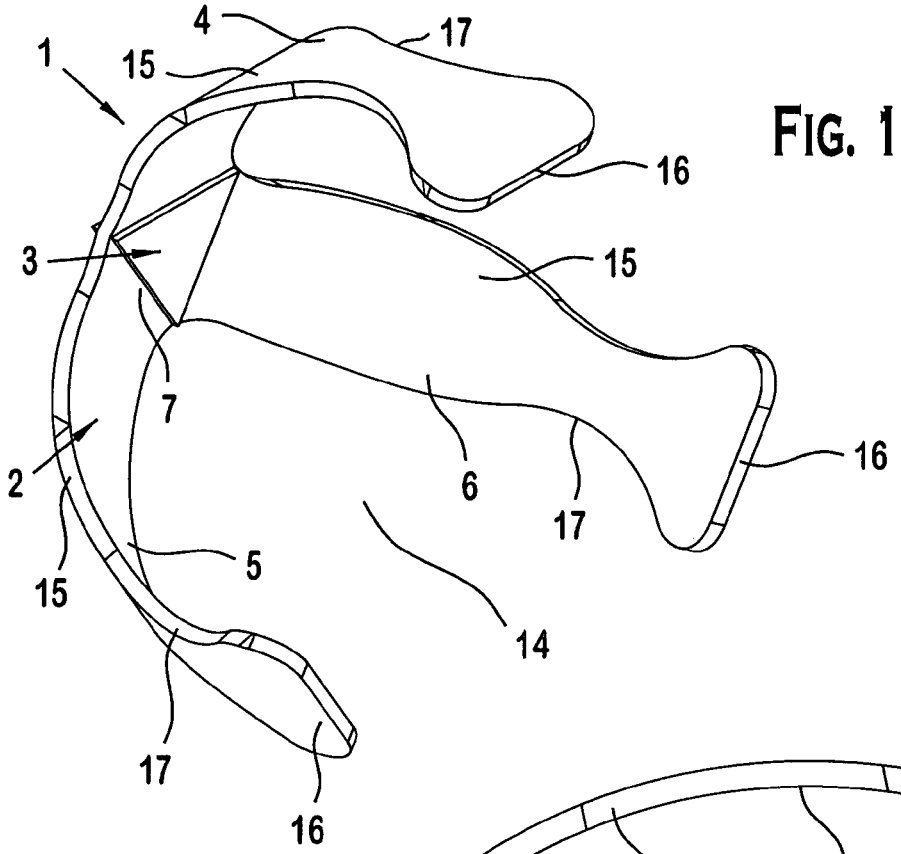
FIG. 1 is a perspective view of a first embodiment of a mountable ball holder according to the invention.

FIGS. 1-4 show a first embodiment of a mountable ball holder 1 according to the invention. As shown in FIG. 1, the ball holder 1 comprises a receiving member 2 and a cover 3. The receiving member 2 consists of first, second, and third arcuate members 4, 5, 6, respectively, that converge to form a mounting portion 7. Although the receiving member 2 is shown as having three of the arcuate members 4, 5, 6 in the illustrated embodiment, it will be appreciated by those skilled in the art that the receiving member 2 may also be formed with two of the arcuate members 4, 5, 6 or more than three of the arcuate members 4, 5, 6.

Figure 2:
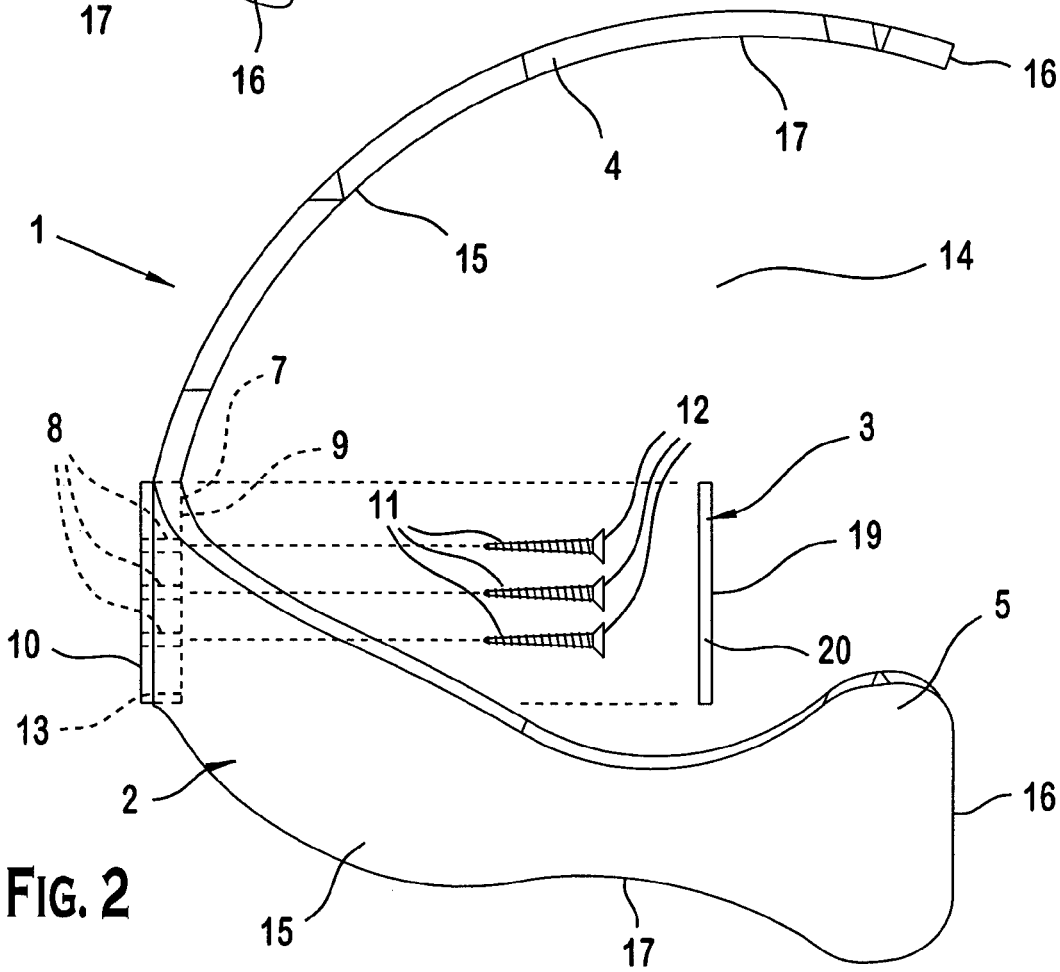
FIG. 2 is an exploded view of the mountable ball holder shown in FIG. 1.
Figure 3:
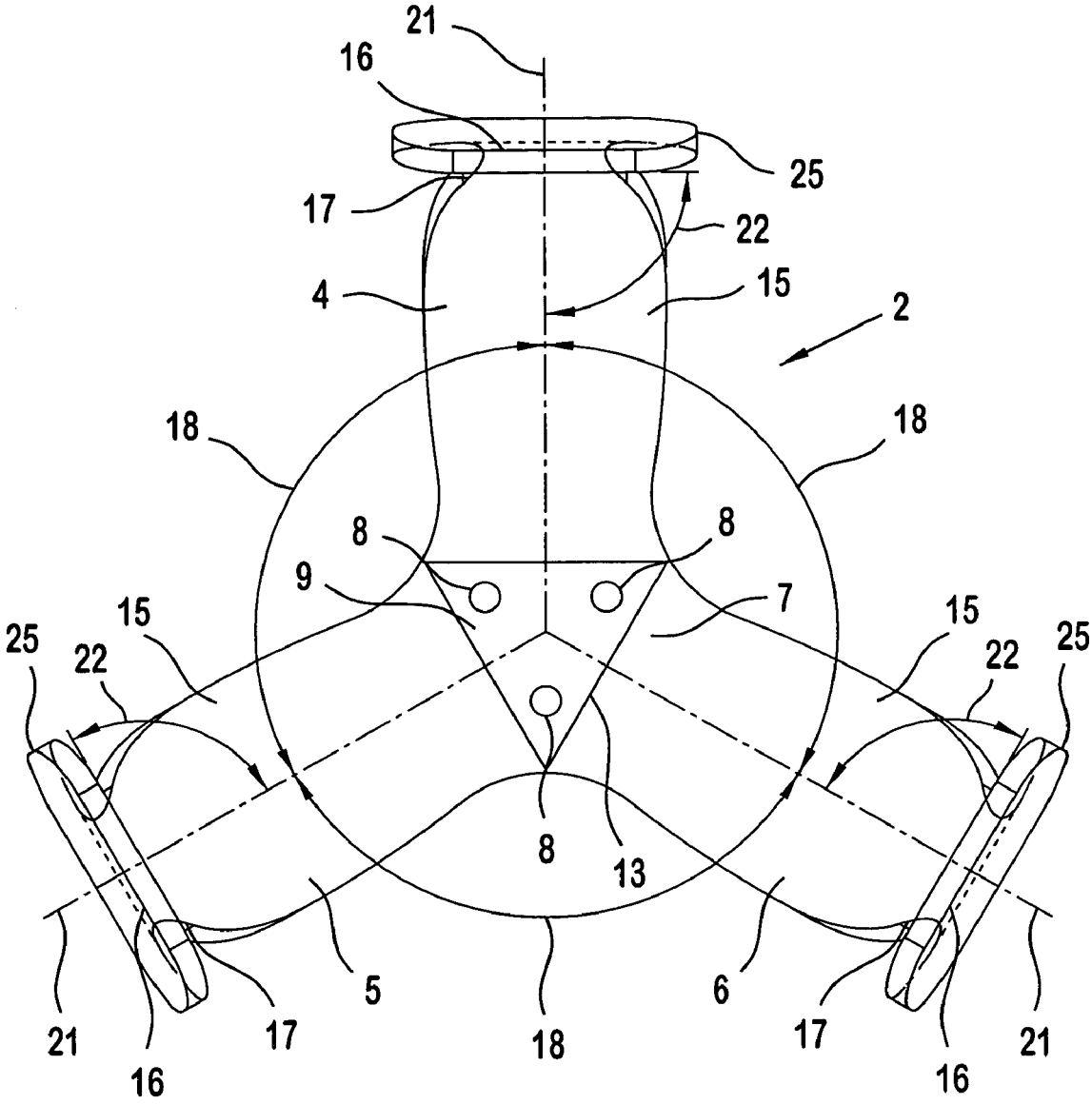
FIG. 3 is a front view of a receiving member of the mountable ball holder shown in FIG. 1.

As shown in FIGS. 2-3, the mounting portion 7 is substantially planar and has a plurality of mounting apertures 8 that extend from an internal surface 9 to an external surface 10 of the mounting portion 7. The mounting apertures 8 have a dimension corresponding to a shaft 11 of a conventional attachment member 12. The attachment member 12 may be, for example, a screw, nail, etc. Although the mounting portion 7 is shown as having three of the mounting apertures 8 in the illustrated embodiment, it will be appreciated by those skilled in the art that the mounting portion 7 may have any number of the mounting apertures 8. Additionally, although the mounting portion 7 is shown as being secured to a support structure 23 in FIG. 4 with the attachment members 12 shown in FIG. 3 in the illustrated embodiment, it will be appreciated by those skilled in the art that the mounting portion 7 may be secured by other conventional methods, such as with an adhesive, rivot, strap, cable, tie, VELCRO, etc. A cover receiving slot 13 encompasses the mounting apertures 8. The cover receiving slot 12 extends from the internal surface 9 toward the external surface 10. Although the cover receiving slot 12 is shown as having a substantially triangular shape in the illustrated embodiment, it will be appreciated by those skilled in the art that the cover receiving slot 12 may have any desired geometric shape.

As shown in FIG. 1, the first, second, and third arcuate members 4, 5, 6 extend from the mounting portion 7 and are integrally formed therewith. The first, second, and third arcuate members 4, 5, 6 are resilient and define a ball receiving area 14. As shown in FIG. 3, the first, second, and third arcuate members 4, 5, 6 each lie in a separate plane and are substantially equiangular relative to each other. For example, in the illustrated embodiment, each of the first, second, and third arcuate members 4, 5, 6 has a longitudinal axis 21 positioned at an angle 18 of about 120 degrees from the longitudinal axis 21 of an adjacent one of the first, second, and third arcuate members 4, 5, 6. As shown in FIG. 1, each of the first, second, and third arcuate members 4, 5, 6 consists of a main body 15 and a free end 16. Proximate the free ends 16, each of the main bodies 15 has a narrow portion 17. Each of the free ends 16 lies in substantially the same plane as its respective main body 15. For example, in the illustrated embodiment, side edges 25 of the free ends 16 are positioned at a free end angle 22 of about 90 degrees relative to the respective longitudinal axis 21. The free ends 16 slightly converge to form a narrow ball receiving opening.

Figure 4:
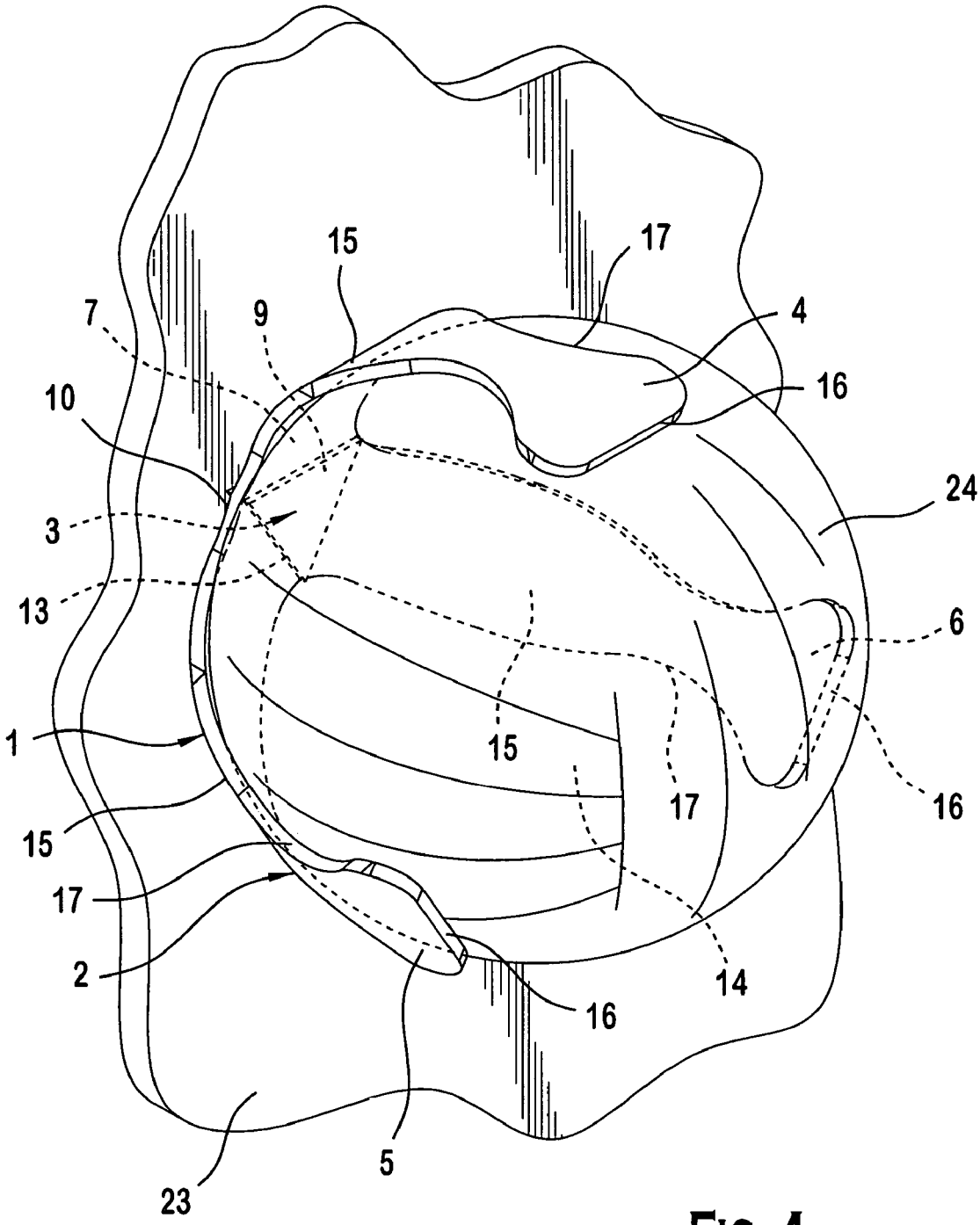
FIG. 4 is a perspective view of the mountable ball holder shown in FIG. 1 shown assembled to a support structure and holding a ball.

The receiving member 2 is formed from a single piece of material, such as plastic, all engineered plastic, sheet metal, wood, etc. Additionally, the receiving member 2 may be formed, for example, by molding or blow molding. The material should be sufficiently rigid enough to support a ball 24, as shown in FIG. 4, while still enabling the first, second, and third arcuate members 4, 5, 6 to deflect and resile. Although the ball 24 is shown as having a substantially spherical shape in the illustrated embodiment, it will be appreciated by those skilled in the art that the ball 24 may have other shapes.

As shown in FIG. 2, the cover 3 has a substantially planar top surface 19. Sidewalls 20 extend from the top surface 19. The sidewalls 20 correspond to the cover receiving slot 13 and are formed to be press-fit therein. Although the sidewalls 20 are shown as being press-fit into the cover receiving slot 13 in the illustrated embodiment, it will be appreciated by those skilled in the art that the cover 3 may be secured to the mounting portion 7 by other conventional methods, such as with an adhesive, etc. The cover 3 may optionally have a cut-out (not shown) formed in the top surface 19 thereof for facilitating removal of the cover 3 from the cover receiving slot 13. The top surface 19 of the cover may optionally have identifying indicia (not shown), such as a trademark or other design, printed or otherwise formed thereon. The cover 3 may be formed from a variety of materials, such as plastic, sheet metal, wood, etc.

In order to assemble and secure the mountable ball holder 1, the external surface 10 of the mounting portion 7 is positioned adjacent to a support structure 23, as shown in FIG. 4. Although the support structure 23 is shown as being oriented in a vertical direction in the illustrated embodiment, it will be appreciated by those skilled in the art that the support structure 23 may be oriented in other directions. Additionally, although the support structure 23 is shown as being a substantially planar surface in the illustrated embodiment, it will be appreciated by those skilled in the art that the support structure 23 may additionally be a strap, a pole, or the like. The shafts 11 of the attachment members 12 are inserted through the mounting apertures 8 and are secured to the support structure 23, as shown in FIGS. 2 and 4. The sidewalls 20 of the cover 3 are press-fit into the cover receiving slot 13 to cover the attachment members 12. The cover 3 thereby conceals the attachment members 12 for an aesthetically pleasing effect and covers any rigid surfaces on the attachment members 12.

In use, the ball 24 is inserted into the narrow ball receiving opening formed by the slightly converged free ends 16 of the first, second, and third arcuate members 4, 5, 6. As the ball 24 is inserted, the first, second, and third arcuate members 4, 5, 6 deflect away from the ball 24 to allow the ball 24 to pass into the ball receiving area 14. The narrowed portions 17 of the main bodies 15 of the first, second, and third arcuate members 4, 5, 6 help to facilitate the deflection of the first, second, and third arcuate members 4, 5, 6. Once the ball 24 is received in the ball receiving area 14, the first, second, and third arcuate members 4, 5, 6 resile to secure the ball 24 in the receiving member 2. Because the attachment members 12 are covered by the cover 3, the ball 24 is prevented from contacting the attachment members 12.

To remove the ball 24 from the receiving member 2, the ball 24 is pulled toward the free ends 16 of the first, second, and third arcuate members 4, 5, 6. As the ball 24 contacts the free ends 16 of the first, second, and third arcuate members 4, 5, 6, the free ends 16 deflect away from the ball 24 to allow the ball 24 to pass out of the ball receiving area 14. Once the ball 24 passes through the ball receiving area 14, the first, second, and third arcuate members 4, 5, 6 resile.

Figure 5:
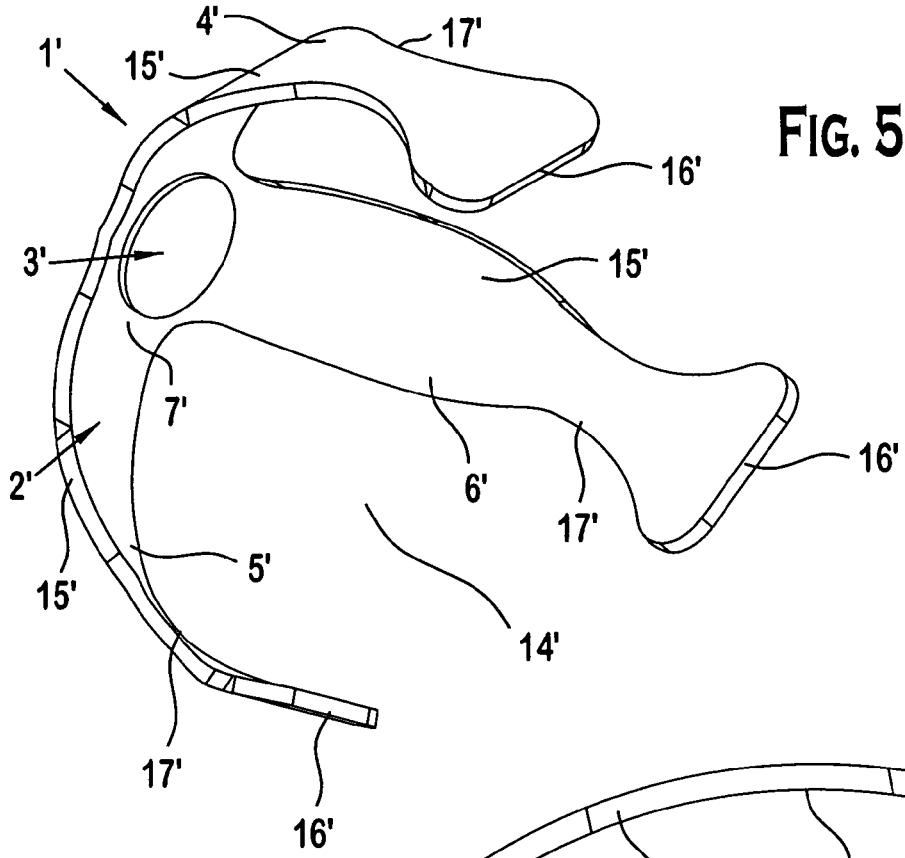
FIG. 5 is a perspective view of a second embodiment of a mountable ball holder according to the invention.

FIGS. 5-8 show a second embodiment of a mountable ball holder 1' according to the invention. As shown in FIG. 5, the ball holder 1' comprises a receiving member 2' and a cover 3'. The receiving member 2' consists of first, second, and third arcuate members 4', 5', 6', respectively, that converge to form a mounting portion 7'. Although the receiving member 2' is shown as having three of the arcuate members 4', 5', 6' in the illustrated embodiment, it will be appreciated by those skilled in the art that the receiving member 2' may also be formed with two of the arcuate members 4', 5', 6' or more than three of the arcuate members 4', 5', 6'.

Figure 6:
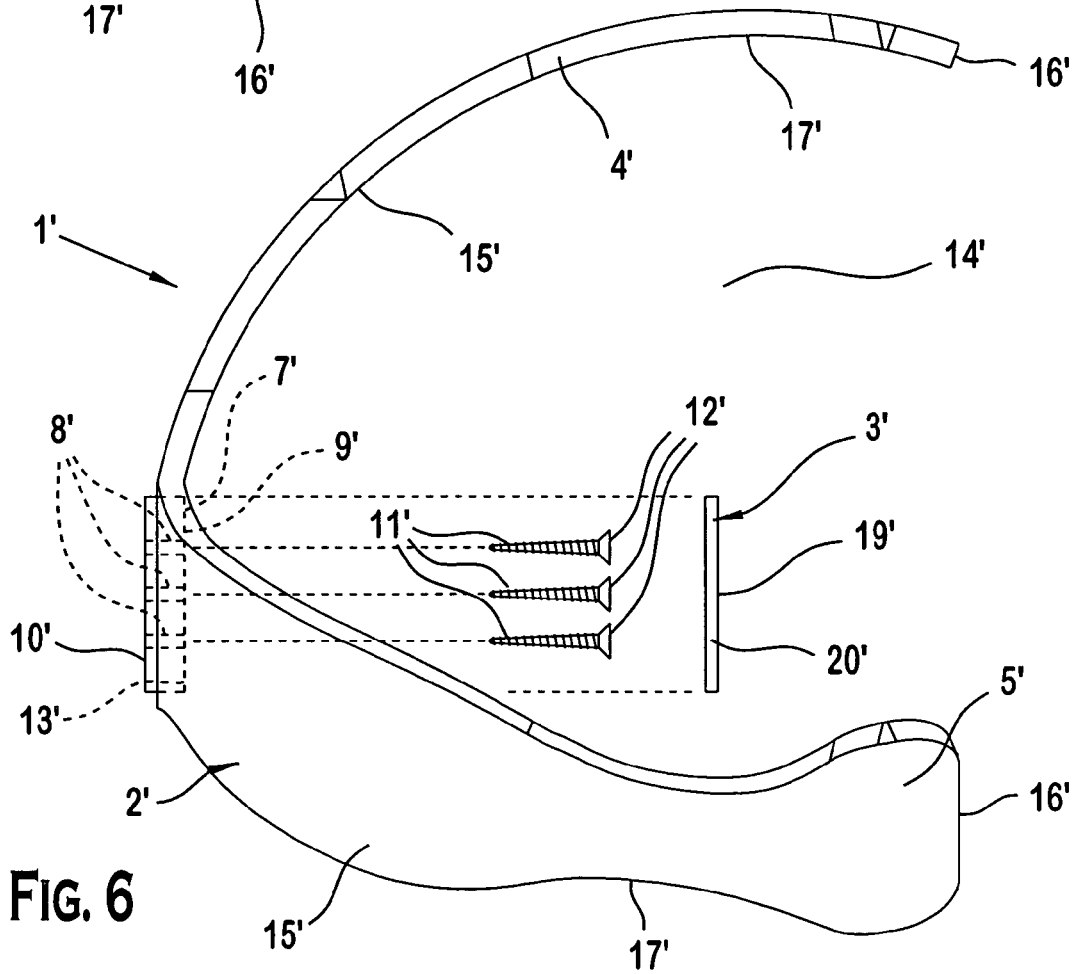
FIG. 6 is an exploded view of the mountable ball holder shown in FIG. 5.
Figure 7:
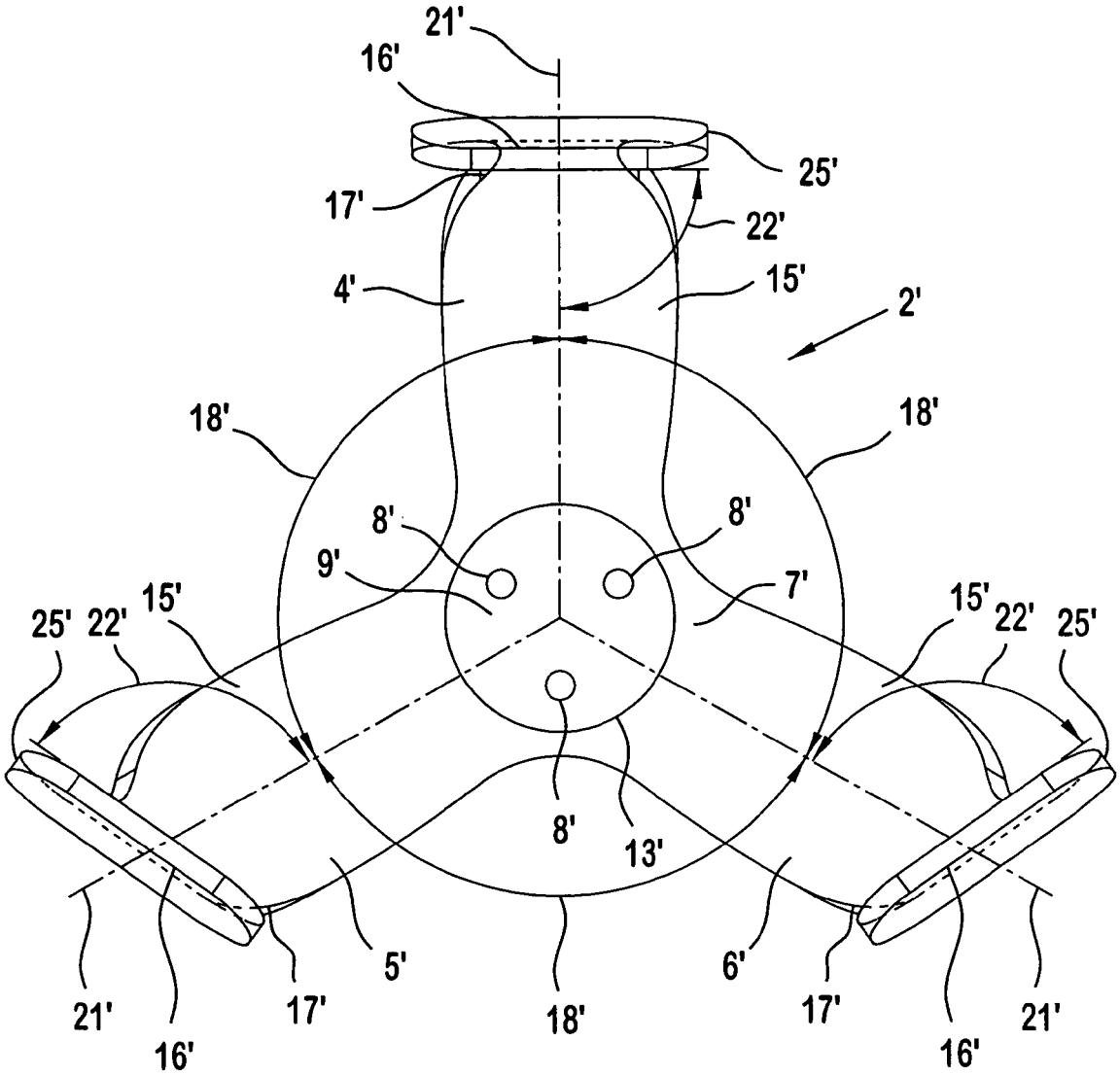
FIG. 7 is a front view of a receiving member of the mountable ball holder shown in FIG. 5.
Figure 8:
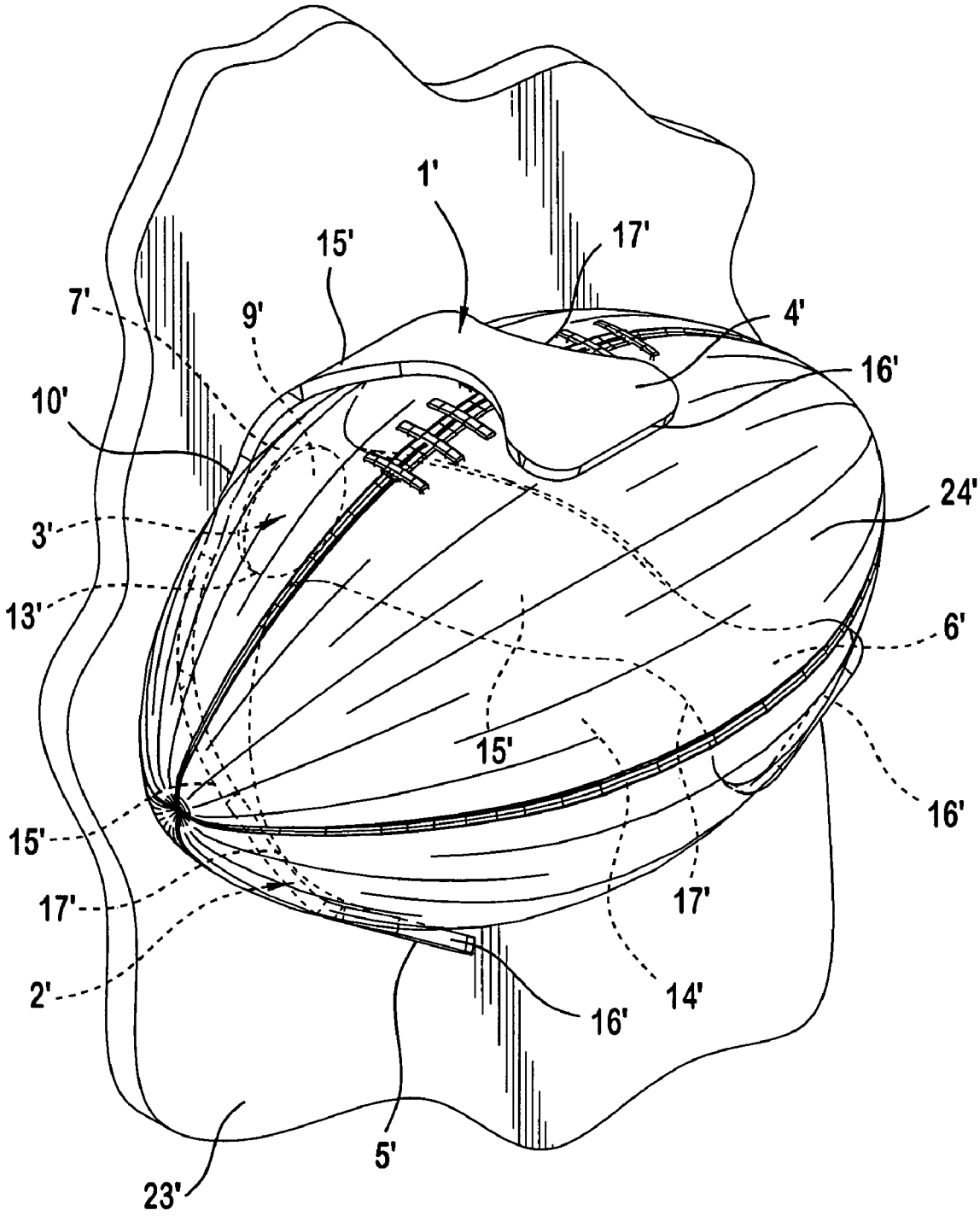
FIG. 8 is a perspective view of the mountable ball holder shown in FIG. 5 shown assembled to a support structure and holding a ball.

As shown in FIGS. 6-7, the mounting portion 7' is substantially planar and has a plurality of mounting apertures 8' that extend from an internal surface 9' to an external surface 10' of the mounting portion 7'. The mounting apertures 8' have a dimension corresponding to a shaft 11' of a conventional attachment member 12'. The attachment member 12' may be, for example, a screw, nail, etc. Although the mounting portion 7' is shown as having three of the mounting apertures 8' in the illustrated embodiment, it will be appreciated by those skilled in the art that the mounting portion 7' may have any number of the mounting apertures 8'. Additionally, although the mounting portion 7' is shown in FIG. 8 as being secured to a support structure 23' with the attachment members 12' shown in FIG. 6 in the illustrated embodiment, it will be appreciated by those skilled in the art that the mounting portion 7' may be secured by other conventional methods, such as with an adhesive, rivot, strap, cable, tie, VELCRO, etc. A cover receiving slot 13' encompasses the mounting apertures 8'. The cover receiving slot 12' extends from the internal surface 9' toward the external surface 10'. Although the cover receiving slot 12' is shown as having a substantially circular shape in the illustrated embodiment, it will be appreciated by those skilled in the art that the cover receiving slot 12' may have any desired geometric shape.

As shown in FIG. 5, the first, second, and third arcuate members 4', 5', 6' extend from the mounting portion 7' and are integrally formed therewith. The first, second, and third arcuate members 4', 5', 6' are resilient and define a ball receiving area 14'. As shown in FIG. 7, the first, second, and third arcuate members 4', 5', 6' each lie in a separate plane and are substantially equiangular relative to each other. For example, in the illustrated embodiment, each of the first, second, and third arcuate members 4', 5', 6' has a longitudinal axis 21' positioned at an angle 18' of about 120 degrees from the longitudinal axis 21' of an adjacent one of the first, second, and third arcuate members 4', 5', 6'. As shown in FIG. 5, each of the first, second, and third arcuate members 4', 5', 6' consists of a main body 15' and a free end 16'. Proximate the free ends 16', each of the main bodies 15' has a narrow portion 17'. The free end 16' of the first arm 4 lies in substantially the same plane as its respective main body 15'. For example, in the illustrated embodiment, side edge 25' of the free end 16' of the first arcuate member 4' is positioned at a free end angle 22' of about 90 degrees relative to the respective longitudinal axis 21'. The free ends 16' of the second and third arcuate members 5' 6' are slightly offset from the plane of the respective main bodies 15'. For example, in the illustrated embodiment, side edges 25' of the free ends 16' of the second and third arcuate members 5' 6' are positioned at a free end angle 22' of about 114 degrees relative to the respective longitudinal axis 21'. The free ends 16' slightly converge to form a narrow ball receiving opening.

The receiving member 2' is formed from a single piece of material, such as plastic, all engineered plastic, sheet metal, wood, etc. Additionally, the receiving member 2' may be formed, for example, by molding or blow molding. The material should be sufficiently rigid enough to support a ball 24', as shown in FIG. 8, while still enabling the first, second, and third arcuate members 4', 5', 6' to deflect and resile. Although the ball 24' is shown as having a substantially elongated shape in the illustrated embodiment, it will be appreciated by those skilled in the art that the ball 24' may have other shapes.

As shown in FIG. 6, the cover 3' has a substantially planar top surface 19'. Sidewalls 20' extend from the top surface 19'. The sidewalls 20' correspond to the cover receiving slot 13' and are formed to be press-fit therein. Although the sidewalls 20' are shown as being press-fit into the cover receiving slot 13' in the illustrated embodiment, it will be appreciated by those skilled in the art that the cover 3' may be secured to the mounting portion 7' by other conventional methods, such as with an adhesive, etc. The cover 3' may optionally have a cut-out (not shown) formed in the top surface 19' thereof for facilitating removal of the cover 3' from the cover receiving slot 13'. The top surface 19' of the cover may optionally have identifying indicia (not shown), such as a trademark or other design, printed or otherwise formed thereon. The cover 3' may be formed from a variety of materials, such as plastic, sheet metal, wood, etc.

The mountable ball holder 1' of the second embodiment is assembled, secured, and used in the same manner as the mountable ball holder 1 of the first embodiment and therefore such assembly, securement, and use will not be described in further detail herein.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A mountable ball holder, comprising:

a receiving member having resilient first, second, and third arcuate members that define a ball receiving area; the first, second, and third arcuate members each lie in a separate plane and converge to form a mounting portion; the first, second, and third arcuate members and the mounting portion being formed in a single piece from a molded plastic material, and the mounting portion having at least one attachment member for securing the receiving member to a support structure; and contoured side ends of the arcuate members having a mid-section formed between two enlarged ends whereby said mid-section is narrower than said enlarged ends.

2. The mountable ball holder of claim 1, farther comprising a cover that is secured to an internal surface of the mounting portion such that the cover conceals the at least one attachment member.

3. The mountable ball holder of claim 2, wherein the mounting portion has a cover receiving slot and the cover is press-fit therein.

4. The mountable ball holder of claim 1, wherein the mounting portion has at least one through-hole for receiving the at least one attachment member.

5. The mountable ball holder of claim 1, wherein the first, second, and third arcuate members each have a free end, the free ends converge to form a ball receiving opening.

6. The mountable ball holder of claim 5, wherein the first, second, and third arcuate members each have a portion proximate the respective free end that is narrower than a remainder of the respective first, second, or third arcuate member.

7. The mountable ball holder of claim 1, wherein the first, second, and third arcuate members each have a longitudinal axis, each of the longitudinal axes being positioned at an angle of about 120 degrees from the longitudinal axis of an adjacent one of the first, second, and third arcuate members.

8. The mountable ball holder of claim 7, wherein the first, second, and third arcuate members each have a free end, the free end of at least two of the arcuate members having a side edge offset from the respective longitudinal axis by more than 90 degrees.

9. A mountable ball holder, consisting of:

a receiving member having resilient first, second, and third arcuate members extending from a mounting portion; the first, second, and third arcuate members defining a ball receiving area; the mounting portion having at least one attachment member for securing an external surface of the mounting portion to a support structure; and a cover that is secured to an internal surface of the mounting portion such that the cover conceals the at least one attachment member; and contoured side ends of the arcuate members having a mid-section formed between two enlarged ends whereby said mid-section is narrower than said enlarged ends.

10. The mountable ball holder of claim 9, wherein the mounting portion has a cover receiving slot and the cover is press-fit therein.

11. The mountable ball holder of claim 9, wherein the mounting portion has at least one through-hole for receiving the at least one attachment member.

12. The mountable ball holder of claim 9, wherein the first, second, and third arcuate members each have a free end, the free ends converge to form a ball receiving opening.

13. The mountable ball holder of claim 12, wherein the first, second, and third arcuate members each have a portion proximate the respective free end that is narrower than a remainder of the respective first, second, or third arcuate member.

14. The mountable ball holder of claim 9, wherein the receiving member is formed from a molded plastic material.

15. The mountable ball holder of claim 9, wherein the first, second, and third arcuate members each have a longitudinal axis, each of the longitudinal axes being positioned at an angle of about 120 degrees from the longitudinal axis of an adjacent one of the first, second, and third arcuate members.

16. The mountable ball holder of claim 15, wherein the first, second, and third arcuate members each have a free end, the free end of at least two of the arcuate members having a side edge offset from the respective longitudinal axis by more than 90 degrees.

* * * * *